US007931267B2

(12) United States Patent
Kajiyama

(10) Patent No.: US 7,931,267 B2
(45) Date of Patent: Apr. 26, 2011

(54) SHEET FEED DEVICE WITH SHEET TRAY GUIDE UNIT

(75) Inventor: Hiroshi Kajiyama, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 84 days.

(21) Appl. No.: 12/314,890

(22) Filed: Dec. 18, 2008

(65) Prior Publication Data

US 2009/0166956 A1 Jul. 2, 2009

(30) Foreign Application Priority Data

Dec. 27, 2007 (JP) ..... 2007-337527

(51) Int. Cl.
*B65H 1/22* (2006.01)

(52) U.S. Cl. ..... 271/164; 271/162

(58) Field of Classification Search ..... 271/145, 271/162, 164; 399/393; 312/334.14, 334.15, 312/334.18, 334.19, 334.21, 334.22, 334.25, 312/334.26, 334.33, 334.39, 334.41, 334.42, 312/334.45

See application file for complete search history.

(56) References Cited

U.S. PATENT DOCUMENTS

| | | | | |
|---|---|---|---|---|
| 4,176,890 | A * | 12/1979 | Gorton | 312/334.41 |
| 5,100,123 | A * | 3/1992 | Kagiura et al. | 271/164 |
| 5,333,850 | A * | 8/1994 | Kushima et al. | 271/164 |
| 5,364,088 | A * | 11/1994 | Maruyama et al. | 271/164 |
| 5,413,409 | A * | 5/1995 | Arai | 312/330.1 |
| 5,918,875 | A * | 7/1999 | Masley et al. | 271/162 |
| 7,604,232 | B2 * | 10/2009 | Nakashima et al. | 271/164 |
| 2007/0041763 | A1 * | 2/2007 | Yoneda | 399/393 |
| 2007/0057444 | A1 | 3/2007 | Sagawa et al. | |
| 2007/0170641 | A1 * | 7/2007 | Asada et al. | 271/145 |
| 2007/0246879 | A1 | 10/2007 | Sagawa et al. | |
| 2008/0001350 | A1 | 1/2008 | Okamoto et al. | |
| 2008/0038039 | A1 | 2/2008 | Watase et al. | |
| 2008/0085140 | A1 | 4/2008 | Kajiyama et al. | |

FOREIGN PATENT DOCUMENTS

| | | |
|---|---|---|
| JP | 09-240849 | 9/1997 |
| JP | 09-255169 | 9/1997 |
| JP | 2005-255336 | 9/2005 |
| JP | 2006-036491 | 2/2006 |
| JP | 2006-206319 | 8/2006 |

* cited by examiner

*Primary Examiner* — Stefanos Karmis
*Assistant Examiner* — Jeremy Severson
(74) *Attorney, Agent, or Firm* — Harness, Dickey & Pierce, PLC

(57) ABSTRACT

A sheet feed device includes a sheet tray and a guide unit. The sheet tray is configured to store a recording medium including a recording sheet. The guide unit is configured to support detachably the sheet tray. The guide unit includes a rotary member that is configured to contact an outer bottom surface of the sheet tray while contacting an outer side surface of the sheet tray, and rotate with mounting and detachment of the sheet tray. An image forming apparatus includes an image bearing member for bearing a latent image on a surface thereof, an exposure unit for exposing the image bearing member to form the latent image, a developing unit for developing the latent image with toner to form a visible image, a transfer unit for transferring the visible image onto the recording medium, and the sheet feed device.

8 Claims, 5 Drawing Sheets

SHEET FEED DEVICE WITH SHEET TRAY GUIDE UNIT

CROSS-REFERENCE TO RELATED APPLICATIONS

This patent application is based on and claims priority pursuant to 35 U.S.C. §119 from Japanese Patent Application No. 2007-337527 filed on Dec. 27, 2007 in the Japan Patent Office, the entire contents of which are hereby incorporated herein by reference.

BACKGROUND OF THE INVENTION

1. Field of the Invention

Exemplary aspects of the present invention generally relate to a sheet feed device and an image forming apparatus including the sheet feed device.

2. Description of the Background Art

Conventionally, there has been known an image forming apparatus that includes a sheet feed device equipped with a sheet tray (or a sheet cassette) for storing a stack of recording media sheets such as paper sheets or the like and a guide member that detachably supports the sheet tray.

In general, in such an image forming apparatus like that disclosed, for example, in JP-2006-36491-A, the sheet tray, or sheet cassette, of the sheet feed device includes rollers on a bottom surface thereof so as to enable the sheet cassette to roll onto a mounting portion or a guide portion formed substantially in the shape of a rectangular hole.

However, in such a related art sheet feed device, there is a drawback in that because the rollers are provided only to the sheet tray, when mounting or detaching the sheet tray relative to the image forming apparatus, that portion of the bottom surface of the sheet tray which lies between the rollers contacts an edge of an opening of the mounting portion, thereby causing rattling and thus preventing the sheet tray from being mounted or detached smoothly.

In this type of sheet feed device, upon mounting the sheet tray into the mounting portion of the sheet feed device, it is important to properly position the sheet tray horizontally in a width direction thereof that is the equivalent of a horizontal direction perpendicular to an imaginary plane through which the sheet tray moves when it is mounted in the sheet feed device (hereinafter referred to as the mounting direction or the mounting/detachment direction).

Accordingly, in general, outer side surfaces of the sheet tray are configured to slide along inner side surfaces of the mounting portion of the sheet feed device. It is to be noted that some clearance is generally provided between the outer side surfaces of the sheet tray and the inner side surfaces of the mounting portion so as to facilitate mounting and detachment of the sheet tray.

With this configuration, however, when mounting or detaching the sheet tray, rattling still occurs, thereby preventing the sheet tray from being smoothly mounted in or detached from the sheet feed device.

SUMMARY OF THE INVENTION

Illustrative embodiments of the present invention provide a sheet feed device that facilitate mounting and detachment of a sheet tray, and an image forming apparatus including the sheet feed device.

According to one preferred embodiment, the sheet feed device includes a sheet tray and a guide unit. The sheet tray is configured to store a recording medium, typically although not necessarily sheets of paper. The guide unit is configured to detachably support the sheet tray. The guide unit includes a rotary member that is configured to contact an outer bottom surface of the sheet tray while contacting an outer side surface of the sheet tray, and rotate with mounting and detachment of the sheet tray.

According to another preferred embodiment, an image forming apparatus that forms an image includes an image bearing member, an exposure unit, a developing unit, a transfer unit, and the sheet feed device described above. The image bearing member is configured to bear an electrostatic latent image on a surface thereof. The exposure unit is configured to irradiate the surface of the image bearing member so as to form the electrostatic latent image thereon. The developing unit is configured to develop the electrostatic latent image on a surface of the image bearing member so as to form a visible image. The transfer unit is configured to transfer the visible image onto a recording medium. The sheet feed device includes the sheet tray and the guide unit described above.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
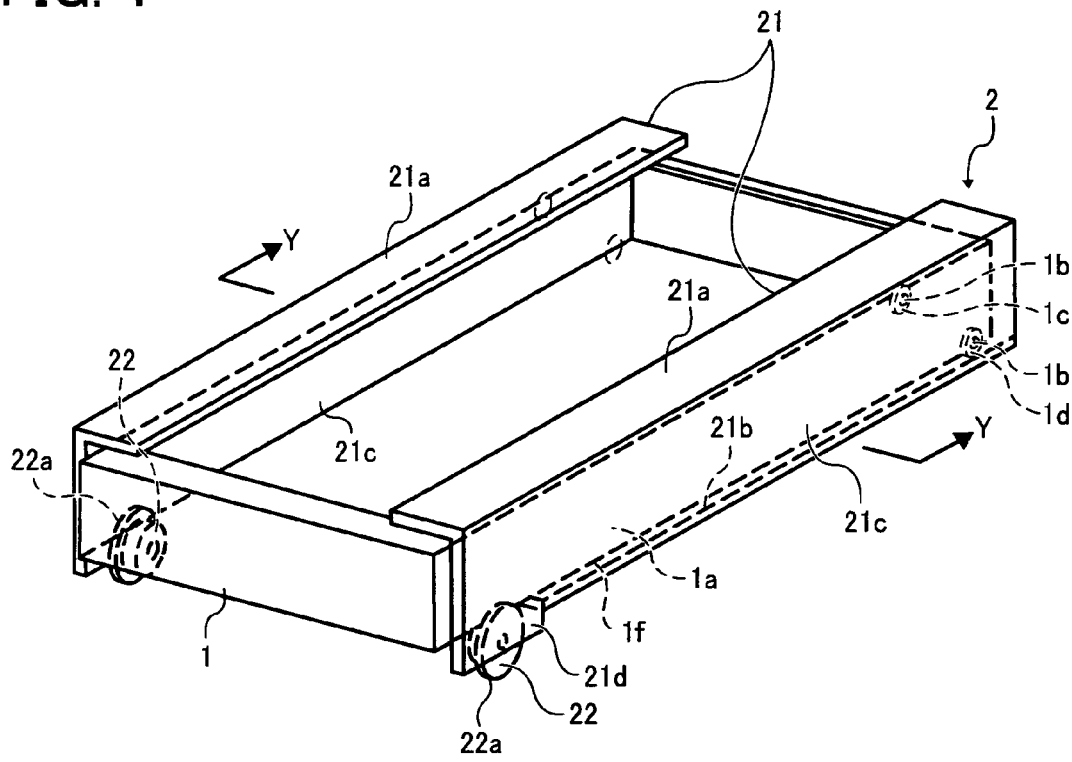
FIG. 1 is a perspective view of a sheet feed device according to an illustrative embodiment of the present invention.

Illustrative embodiments of the present invention are now described below with reference to the accompanying drawings.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity of drawings and descriptions, the same reference numerals are given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included.

Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially to FIG. 1, one example of a sheet feed device, according to an illustrative embodiment of the present invention is described.

First Embodiment

FIG. 1 is a perspective view illustrating a sheet feed device according to an illustrative embodiment of the present invention. As illustrated in FIG. 1, the sheet feed device includes a sheet tray 1 and a guide unit 2.

The sheet tray 1 has a substantially box-like shape allowing a plurality of recording sheets such as paper sheets to be stored from above. The sheet tray 1 includes outer side surfaces 1*a*1 and 1*a*2 at both sides thereof in the horizontal direction perpendicular to the mounting/detachment direction relative to the guide unit 2 described later. It is to be noted that the same configuration is employed at both outer side surfaces 1*a*1 and 1*a*2. Thus, a description is provided that refers to the side surfaces 1*a*1 and 1*a*2 collectively as side surface 1*a*.

Near one longitudinal end of the outer side surface 1*a* in the mounting/detachment direction of the sheet tray 1, a pair of support shafts 1*b*1 and 1*b*2 are disposed in a projecting manner substantially perpendicular to the outside surface at substantially the top and the bottom of the outer side surface 1*a*.

As will be later described, each of an upper roller 1*c* and a lower roller 1*d* is rotatably supported by the support shafts 1*b* such that the upper roller 1*c* and the lower roller 1*d* can rotatably move along an upper rail 21*a* and a lower rail 21*b*, respectively, of guide rails 21 described in detail later.

Further, each of the support shafts 1*b* is provided such that the support shafts 1*b* project from the upper roller 1*c* and the lower roller 1*d* so that the support shafts 1*b* are in the vicinity of or slightly in contact with a side wall 21*c* of the guide rail 21.

The end near which the upper roller 1*c* and the lower roller 1*d* are provided (hereinafter also referred to as a distal end) is the end that is inserted into the interior of an image forming apparatus, not illustrated in FIG. 1. The opposite side of the sheet tray 1 is the front or proximal end of the sheet tray 1, and when the sheet tray is inserted into the image forming apparatus this front or proximal end is substantially flush with an outside surface of the image forming apparatus, whether front, back, or lateral side.

The surface of the sheet tray 1 at the same side of the outer surface of the image forming apparatus includes a recessed portion, not illustrated, intended to function as a handle or a grip for a user to grasp when pulling or pushing the sheet tray 1.

The guide unit 2 includes a pair of opposed guide rails 21 disposed on opposed lateral sides of the guide unit 2 and rotary members 22. Each of the guide rails 21 is provided at one of the left and the right lateral sides of the guide unit 2 and has the same configuration as the other. Thus, for simplicity, although a description is provided of only one of the guide rails 21, it is to be noted that the description applies equally to both of the guide rails 21.

As noted above, the guide rail 21 includes the upper rail 21*a* and the lower rail 21*b*. The upper rail 21*a* is a batten plate member. The lower rail 21*b* is also a batten plate member substantially shorter than the upper rail 21*a*. The upper rail 21*a* and the lower rail 21*b* are disposed parallel to each other, with the distal end of both the upper rail 21*a* and the lower rail 21*b* in line with each other in the width direction.

Figure 3:
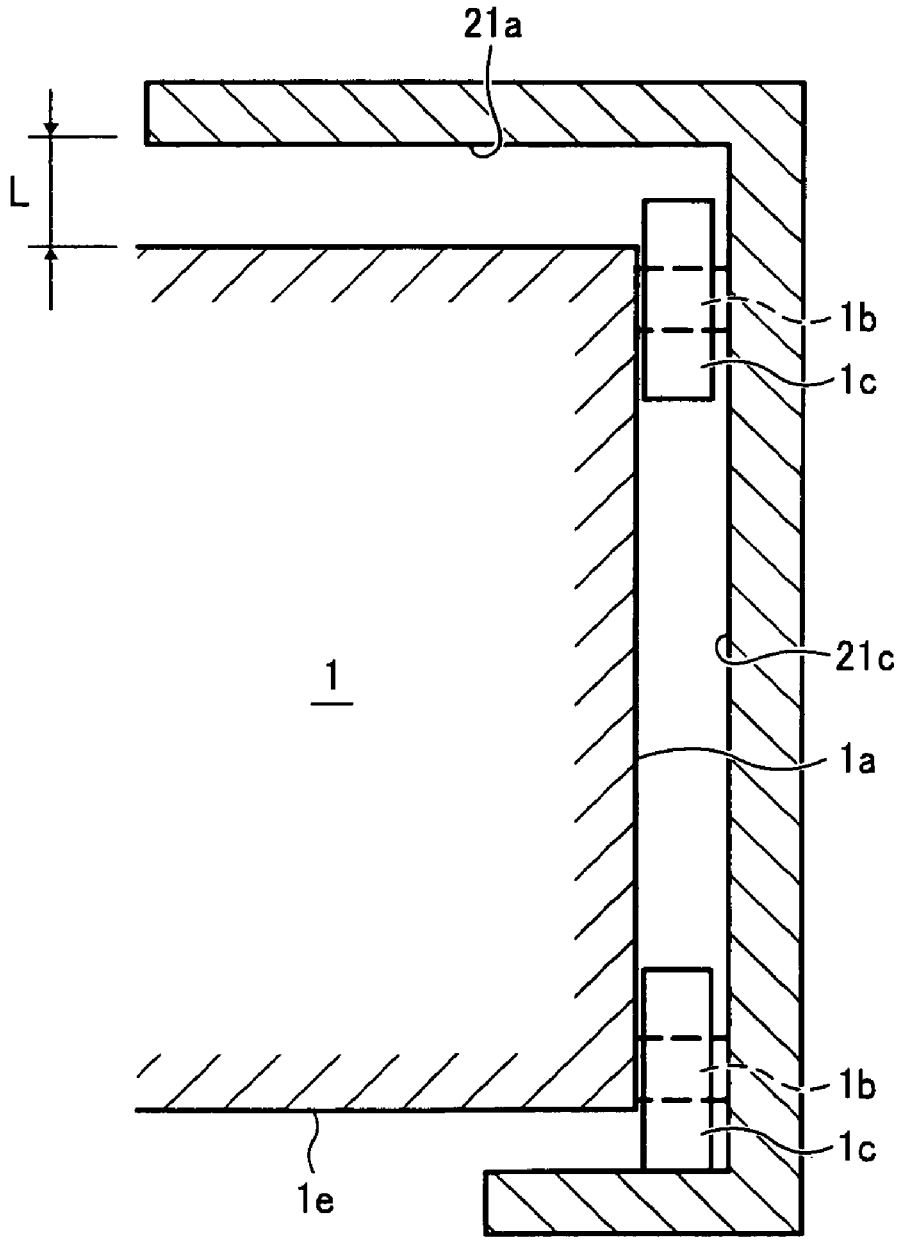
FIG. 3 is a partially enlarged cross-sectional view of the sheet tray taken along a line Y-Y shown in FIG. 1 according to an illustrative embodiment of the present invention.

The long edge of the upper rail 21*a* and the long edge of the lower rail 21*b* are connected by the side wall 21*c*, thereby forming a substantially C-shaped member in latitudinal cross-section as illustrated in FIG. 3. FIG. 3 is a partially enlarged cross-sectional view of the sheet tray 1 along a line Y-Y shown in FIG. 1.

As illustrated in FIG. 1, the side wall 21*c* at the proximal end of the lower rail 21*b* extends downward so as to form a shaft support portion 21*d* that rotatably supports the rotary member 22 by a shaft.

Figure 2:
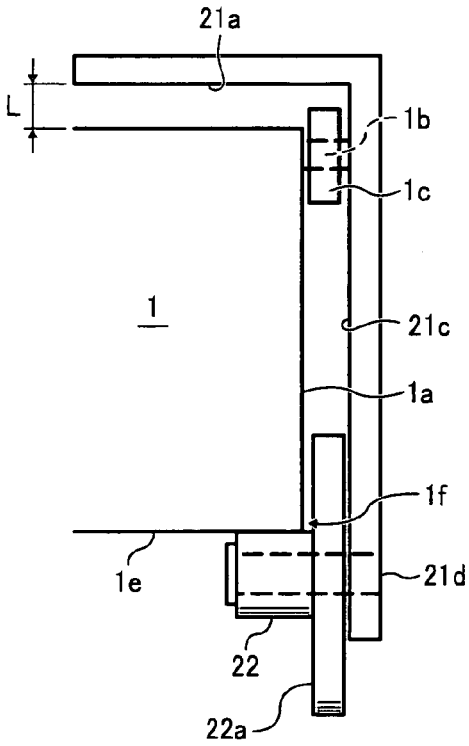
FIG. 2 is a partially enlarged front view of a sheet tray of the sheet feed device of FIG. 1 according to an illustrative embodiment of the present invention.

FIG. 2 is a partially enlarged front view of the sheet tray 1 of the sheet feed device of FIG. 1.

A distance between the upper rail 21*a* and the lower rail 21*b* is such that, when the lower roller 1*d* of the sheet tray 1 contacts the upper surface of the lower rail 21*b* on which the lower roller 1*d* moves, a predetermined amount of clearance L remains between the upper roller 1*c* and the upper rail 21*a*, as illustrated in FIG. 2.

The pair of opposed guide rails 21 is provided horizontally inside the image forming apparatus such that the left and the right guide rails 21 cover the outer side surfaces 1*a* of the sheet tray 1, and the shaft support portion 21*d* is positioned inside the image forming apparatus, but closer to the outside thereof than is the distal end of the sheet tray 1 with the pair of support shafts 1*b*1 and 1*b*2.

As illustrated in FIG. 2, the rotary member 22 has a substantially shaft-like shape including a flange 22*a*. The flange 22*a* is configured to contact a corner 1*f* that is a corner of a bottom surface 1*e* and the outer side surface 1*a* of the sheet tray 1. The rotary member 22 is rotatably supported by the shaft support portion 21*d*, that is, the downwardly-extending portion of the side wall 21*c*.

The rotary member 22 is formed of a relatively frictionless material, such as polyoxymethylene (POM) resin or any other suitable material. The rotary member 22 is configured to rotatably move in accordance with mounting/detachment of the sheet tray 1. When the sheet tray 1 is installed inside the guide rails 21, the rotary members 22 contact the bottom surface of the sheet tray 1 so as to support the sheet tray 1.

At the same time, the sheet tray 1 is prevented from shifting laterally by each of the flanges 22*a* that contacts or substantially contacts the outside surface 1*a* of the sheet tray 1 while the rotary members 22 rotate.

Figure 8:
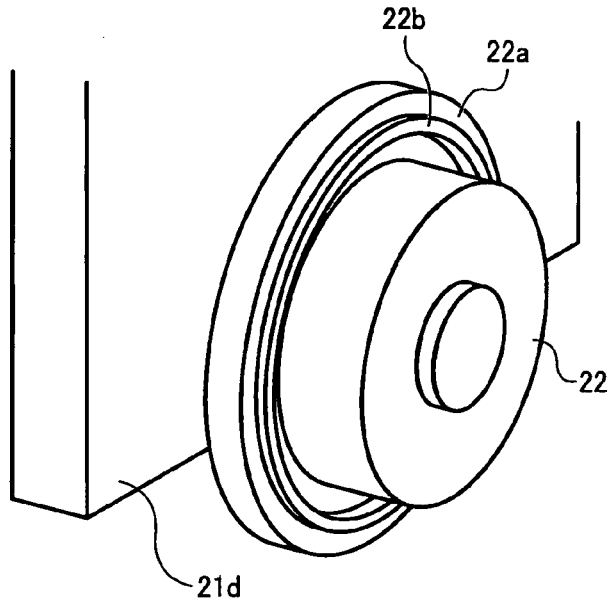
FIG. 8 is a perspective view of an example of a rotary member according to an illustrative embodiment of the present invention.

Alternatively, as illustrated in FIG. 8, each of the rotary members 22 may include a circular rib 22*b*. In this case, the circular rib 22*a* is provided in a protruding manner on the surface of the flange 22*a* that may contact the outer side surface 1*a* of the sheet tray 1.

With this configuration, a contact area of the outer side surface 1*a* of the sheet tray 1 with the flange 22*a* can be reduced, thereby also reducing frictional resistance between the outer side surface 1*a* and the flange 22*a* and thus necessitating less controlling force to mount or detach the sheet tray 1.

Figure 4:
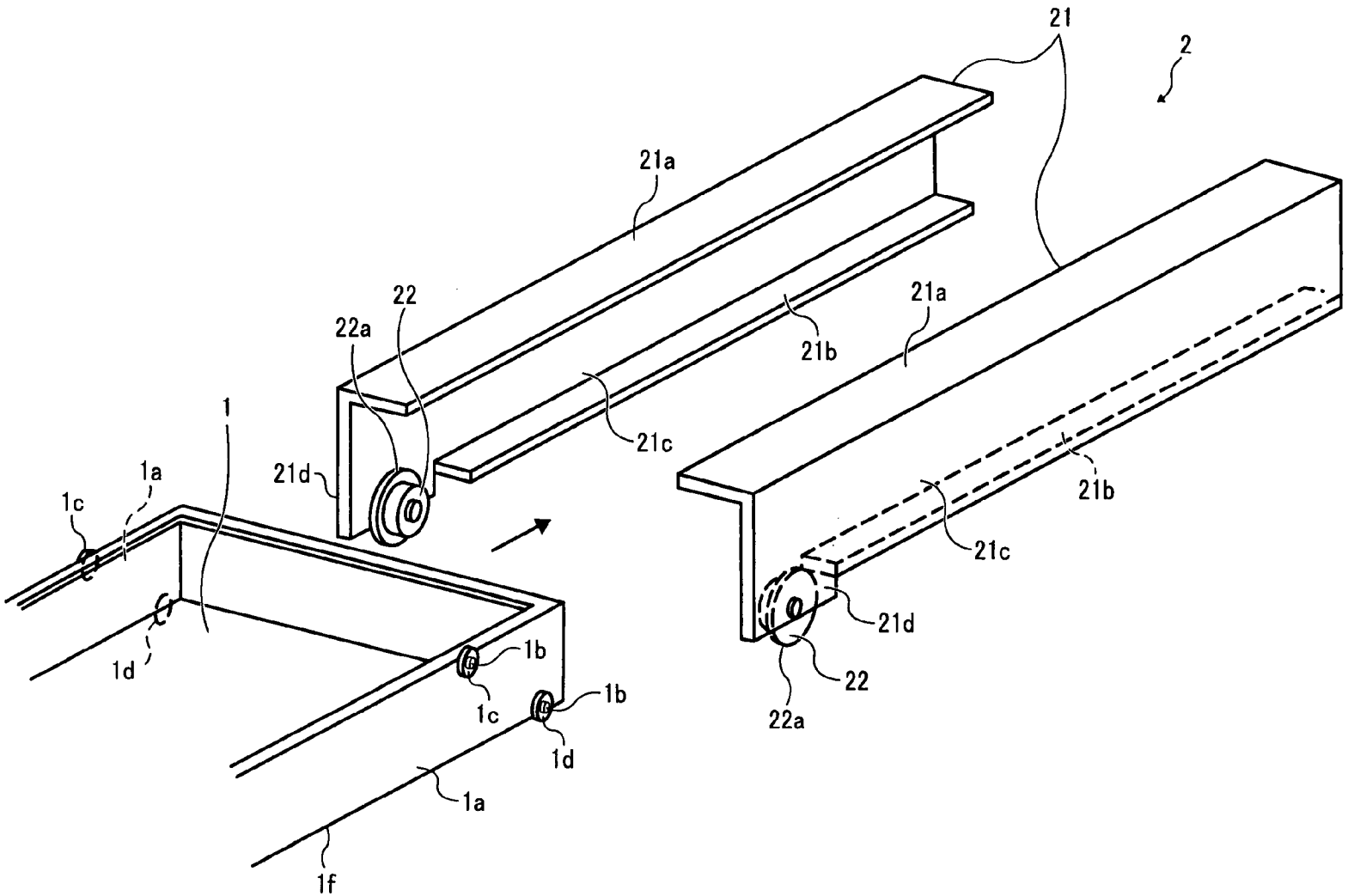
FIG. 4 is a perspective view of the sheet tray and a guide unit of the sheet feed device according to an illustrative embodiment of the present invention.

Referring now to FIG. 4, there is provided a perspective view of the sheet tray 1 and the pair of the guide rails 21. With reference to FIG. 4, a description is provided of operation of the above-described sheet feed device, according to the illustrative embodiment 1.

As illustrated in FIG. 4, when mounting the sheet tray 1 after the recording sheets are provided therein, the sheet tray 1 is inserted into the guide rails 21 from the distal end (constituting a leading end) of the sheet tray 1, at which the upper rollers 1*c* and the lower rollers 1*d* are disposed.

It is to be noted that the upper roller 1*c* is disposed at a different position than the lower roller 1*d* in the mounting/dismounting direction of the sheet tray 1 so that the sheet tray 1 can be inserted into the pair of the guide rails 21 with ease.

Figure 5:
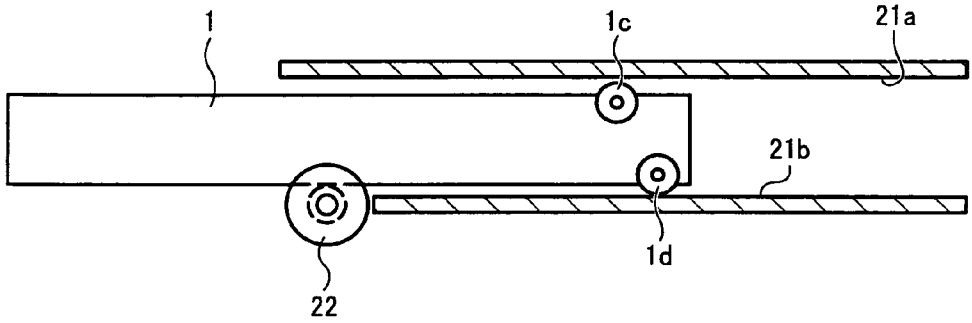
FIG. 5 is a conceptual schematic diagram illustrating mounting of the sheet tray halfway through the guide unit of FIG. 4 according to an illustrative embodiment of the present invention.

Referring now to FIG. 5, there is provided a conceptual schematic diagram conceptually illustrating the sheet tray 1 being inserted or withdrawn halfway through the guide rails 21.

Figure 6:
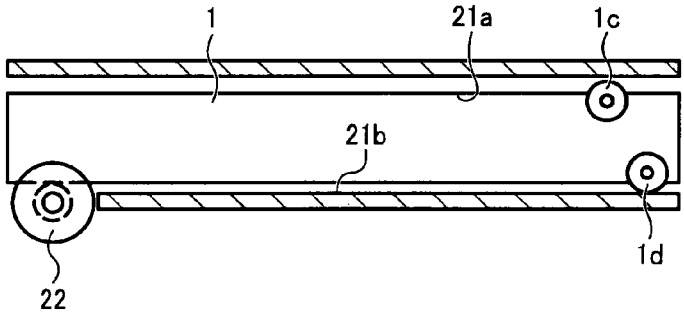
FIG. 6 is a conceptual schematic diagram illustrating the sheet tray fully mounted in the guide unit according to an illustrative embodiment of the present invention.

As illustrated in FIG. 5, by pressing the sheet tray 1 into the guide rails 21, the lower roller 1*d* rolls onto the lower rail 21*b*, and the rotary member 22 contacting the bottom surface 1*e* of the sheet tray 1 rotates in association with traveling of the sheet tray 1 in the horizontal direction. Accordingly, the sheet tray 1 travels to a predetermined position, thereby completing mounting of the sheet tray 1 as illustrated in FIG. 6. FIG. 6 is a conceptual schematic diagram illustrating the sheet tray 1 fully mounted in the guide unit 2.

It is to be noted that, when the sheet tray 1 arrives at the predetermined position, the sheet tray 1 is detachably held in the guide unit 2 by an engagement mechanism, not illustrated. The engagement mechanism may be a known engagement mechanism including a recessed portion and a projecting portion configured to engage each other.

At this time, as illustrated in FIG. 2, the flange 22*a* of the rotary member 22 contacts or substantially contacts the outer side surface 1*a* of the sheet tray 1 so that shifting of the sheet tray 1 laterally is minimized.

Furthermore, as illustrated in FIG. 3, the tip of each of the support shafts 1*b* of the upper roller 1*c* and the lower roller 1*d* contacts or substantially contacts the side wall 21*c*, thereby preventing undesirable lateral shifting of the sheet tray 1.

Next, a description is provided of withdrawing the sheet tray 1 from the guide unit 2. As illustrated in FIG. 5, when the sheet tray 1 is pulled out with a predetermined force, the above-described engagement mechanism is disengaged, allowing the lower roller 1*d* to roll onto the lower rail 21*b*, and the rotary member 22 contacting the bottom surface 1*e* of the sheet tray 1 rotates as the sheet tray 1 is withdrawn.

Figure 7:
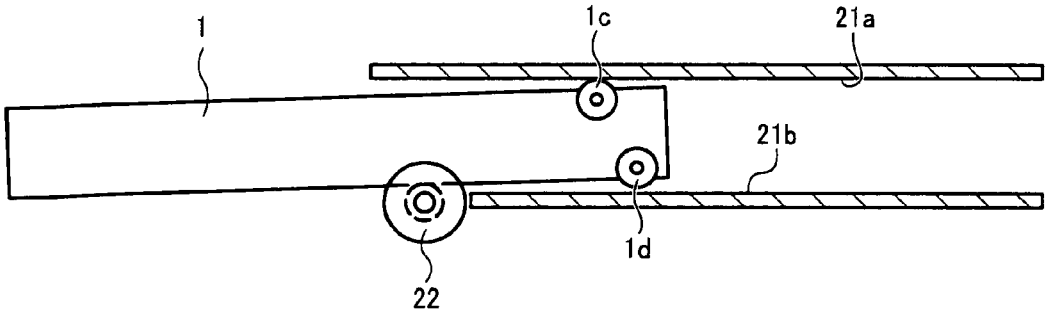
FIG. 7 is a schematic diagram conceptually illustrating detachment of the sheet tray halfway through the guide unit according to an illustrative embodiment of the present invention.

When the sheet tray 1 is pulled out to some extent, due to the weight of the projecting portion of the sheet tray 1 that has been pulled outside the image forming apparatus, the sheet tray 1 tilts or turns about the rotary member 22 serving as a fulcrum point in the counterclockwise direction in FIG. 7. FIG. 7 is a conceptual schematic diagram conceptually illustrating the sheet tray 1 being withdrawn halfway through the guide rails 21.

However, when the upper roller 1*c* is provided, the upper roller 1*c* contacts the upper rail 21*a* and rotates, thereby allowing the sheet tray 1 to be pulled out smoothly.

In general, when a user installs the sheet tray 1 into the image forming apparatus, due to the weight of recording sheets in the sheet tray 1, the user is most likely to securely grasp the sheet tray 1 and insert the sheet tray 1 into the guide unit 2. Even after the sheet tray 1 is mounted in the guide unit 2, the user is likely to keep holding the sheet tray 1 until the sheet tray 1 is securely mounted. For this reason, it is most likely the case that the upper roller 1*c* does not contact and rotate along the upper rail 21*a*.

On the other hand, when the user pulls out the sheet tray 1, the user tends to grasp a recessed portion, not illustrated, of the sheet tray 1 intended for the user to grasp and pull out incautiously the sheet tray 1 to a certain degree so as not to drop the sheet tray 1.

According to the illustrative embodiment, the upper roller 1*c* and the upper rail 21*a* are provided so that, regardless of the way the user pulls out or inserts the sheet tray 1, the sheet tray 1 can still be reliably mounted or detached smoothly.

According to the illustrative embodiment 1, the guide unit 2 that detachably supports the sheet tray 1 storing the recording sheets includes the rotary members 22. The rotary members 22 rotate in accordance with movement, that is, mounting/dismounting of the sheet tray 1, thereby allowing the sheet tray 1 to be mounted or detached smoothly.

Further, the rotary members 22 contact the bottom surface 1*e* of the sheet tray 1 so as to support the sheet tray 1 while rotating and contacting or substantially contacting the outer surfaces 1*a* of the sheet tray 1. Accordingly, the sheet tray 1 is prevented from shifting laterally, that is, in a direction perpendicular to the mounting/dismounting direction, thereby facilitating positioning of the sheet tray 1 in the width direction and smooth mounting/detaching operation by the user.

Second Embodiment

Next, a description is provided of a sheet feed device according to another illustrative embodiment.

The sheet feed device according to another illustrative embodiment includes another example of the rotary members 22 and the sheet tray 1 that engages the rotary members 22.

It is to be noted that the guide rails 21, the upper rollers 1*c*, the lower rollers 1*d*, and so forth according to the present illustrative embodiment have substantially the same configuration as those of the first illustrative embodiment, and thus descriptions thereof are omitted, unless otherwise specified.

Figure 9:
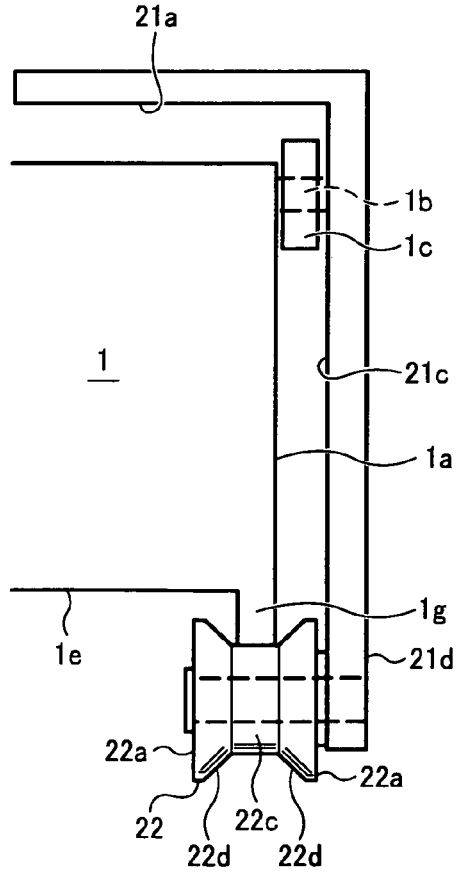
FIG. 9 is a partially-enlarged front view of the sheet feed device according to another illustrative embodiment of the present invention.

With reference to FIG. 9, a description is provided of the present illustrative embodiment. FIG. 9 is a partially-enlarged front view of the sheet feed device.

According to the present illustrative embodiment, as illustrated in FIG. 9, the sheet tray 1 includes a rib 1*g*. The rib 1*g* extends downward by a predetermined amount from the edge portion of the bottom surface 1*e* of the sheet tray 1, has a predetermined width, and extends along the outside surface 1*a* of the sheet tray 1 in the mounting/detachment direction.

According to the illustrative embodiment, the rotary member 22 includes a round shaft portion 22*c* that is slightly longer than the width of the rib 1*g*. The rotary member 22 includes also flanges 22*a* including slanted inner surfaces 22*d*. The slanted inner surfaces 22*d* gradually expand outward toward rims of the rotary member 22. The rotary member 22 according to the present illustrative embodiment may look like a bobbin, and is rotatavely supported by the shaft support portion 21*d* formed on the guide rail 21.

With this configuration, according to the present illustrative embodiment, when the sheet feed device is mounted, the rib 1*g* of the sheet tray 1 fits relatively loosely between the flanges 22*a* of the rotary member 22.

Further, similar to the illustrative embodiment 1, the rotary member 22 rotates in association with traveling of the sheet tray 1 in the horizontal direction. Consequently, since the inner surfaces 22*d* facing the rib 1*g* are formed slanting gradually outward, when the sheet tray 1 is mounted or detached and the sheet tray 1 shifts laterally inadvertently, the sheet tray 1 can return immediately to its proper position, that is, the shaft portion 22*c*, thereby aligning reliably the sheet tray 1. With this configuration, the sheet tray 1 can be mounted or detached smoothly.

According to the second illustrative embodiment, since the inner surfaces 22*d* of the flange 22*a*, facing the rib 1*g* are formed slanting gradually outward in the direction outside the shaft, the inner surfaces 22*d* either barely contact the outer side surface 1*a* or they do not contact the outer side surface 1*a* at all. Thus, the sheet tray 1 can be mounted or detached with little force compared to the configuration according to the first illustrative embodiment.

It is to be noted, however, that, alternatively, the flange 22*a* of the rotary member 22 may have a substantially H-shaped form. Still further, alternatively, the sheet tray 1 need not include the rib 1*g*, similar to the sheet tray 1 of the illustrative embodiment 1, while the rotary member 22 may be provided with the flange 22*a* having slanted surfaces.

The foregoing description pertains to the sheet feed device according to the illustrative embodiments of the present invention. The sheet feed device according to the illustrative embodiments of the present invention can be employed in an image forming apparatus.

In such a case, the image forming apparatus uses an image forming method including, but not limited to, an electrophotographic method, a method using inkjet, or any other suitable method to form an image.

It is to be noted that elements and/or features of different illustrative embodiments may be combined with each other and/or substituted for each other within the scope of this disclosure and appended claims.

In addition, the number of constituent elements, locations, shapes and so forth of the constituent elements are not limited to any of the structure illustrated in the drawings.

Still further, any one of the above-described and other illustrative features of the present invention may be embodied in the form of an apparatus or system.

Illustrative embodiments being thus described, it is obvious that the same may be varied in many ways. Such illustrative variations are not to be regarded as a departure from the scope of the present invention, and all such modifications as would be obvious to one skilled in the art are intended to be included within the scope of the following claims.

What is claimed is:

1. A sheet feed device, comprising:

a sheet tray configured to store a recording medium sheet; and a guide unit configured to support detachably the sheet tray, the guide unit including a rotary member configured to contact an outer bottom surface of the sheet tray while contacting an outer side surface of the sheet tray, and rotate with mounting and detachment of the sheet tray, wherein the rotary member has a shaft-like shape and includes a flange that contacts a corner of the outer bottom surface and the outer side surface of the sheet tray, and the rotary member includes a circular rib provided in a projecting manner on a surface of the flange that contacts the outer side surface of the sheet tray.

2. The sheet feed device according to claim 1, wherein the rotary member is formed of a low friction material.

3. The sheet feed device according to claim 2, wherein the rotary member is formed of polyoxymethylene (POM) resin.

4. The sheet feed device according to claim 1, wherein the guide unit comprises a pair of opposed guide rails disposed on opposed lateral sides of the guide unit, each guide rail including:

a lower rail formed of a batten plate configured to support the sheet tray;

an upper rail formed of a batten plate configured to cover a top surface of the sheet tray at least partially; and a side wall that connects the lower rail and the upper rail and on which the rotary member is pivotally supported next to the lower rail, wherein the lower rail, the upper rail, and the side wall form a substantially C-shaped member in latitudinal cross-section so as to surround the end portion of the sheet tray, wherein the rotary member of the guide unit is provided at a proximal end substantially near a graspable portion of the sheet tray, and wherein the sheet tray further includes a lower roller provided substantially at a distal end portion thereof opposite the proximal end at which the graspable portion is provided to enable the sheet tray to travel on the lower rail.

5. The sheet feed device according to claim 4, wherein the sheet tray further includes an upper roller provided substantially at the distal end portion thereof opposite the proximal end at which the graspable portion is provided to enable the sheet tray to travel along the upper rail, wherein an amount of clearance is formed between an outer peripheral surface of the upper roller and a contact surface of the upper rail when the sheet tray is inserted into the sheet feed device.

6. The sheet feed device according to claim 4, wherein the lower roller is disposed such that the lower roller or a shaft of the lower roller contacts or substantially contacts the side wall of the guide rail.

7. An image forming apparatus for forming an image, comprising:

an image bearing member configured to bear an electrostatic latent image on a surface thereof;

an exposure unit configured to irradiate the surface of the image bearing member so as to form the electrostatic latent image thereon;

a developing unit configured to develop the electrostatic latent image on a surface of the image bearing member so as to form a visible image;

a transfer unit configured to transfer the visible image onto a recording medium; and a sheet feed device, including a sheet tray configured to store one or more sheets of the recording medium including a recording sheet; and a guide unit disposed in the image forming apparatus, configured to support detachably the sheet tray, the guide unit including a rotary member configured to contact an outer bottom surface of the sheet tray while contacting an outside surface of the sheet tray, and rotate with mounting and detachment of the sheet tray, wherein the rotary member has a shaft-like shape and includes a flange that contacts a corner of the outer bottom surface and the outside surface of the sheet tray, and the rotary member includes a circular rib provided in a projecting manner on a surface of the flange that contacts the outside surface of the sheet tray.

8. A sheet feed device, comprising:

a sheet tray configured to store a recording medium sheet; and a guide unit configured to support detachably the sheet tray, the guide unit including a rotary member configured to contact an outer bottom surface of the sheet tray while contacting an outer side surface of the sheet tray, and rotate with mounting and detachment of the sheet tray, wherein the guide unit further includes a pair of opposed guide rails disposed on opposed lateral sides of the guide unit, each guide rail including:

a lower rail formed of a batten plate configured to support the sheet tray, an upper rail formed of a batten plate configured to cover a top surface of the sheet tray at least partially, and a side wall that connects the lower rail and the upper rail and on which the rotary member is pivotally supported next to the lower rail, the lower rail, the upper rail, and the side wall form a substantially C-shaped member in latitudinal cross-section so as to surround the end portion of the sheet tray, the rotary member of the guide unit is provided at a proximal end substantially near a graspable portion of the sheet tray, the sheet tray further includes a lower roller provided substantially at a distal end portion thereof opposite the proximal end at which the graspable portion is provided to enable the sheet tray to travel on the lower rail, the sheet tray further includes an upper roller provided substantially at the distal end portion thereof opposite the proximal end at which the graspable portion is provided to enable the sheet tray to travel along the upper rail, and an amount of clearance is formed between an outer peripheral surface of the upper roller and a contact surface of the upper rail when the sheet tray is inserted into the sheet feed device.

* * * * *